US007044305B2

(12) United States Patent
Girondi et al.

(10) Patent No.: US 7,044,305 B2
(45) Date of Patent: May 16, 2006

(54) TOY CARRYING PACKAGE

(75) Inventors: Mark V. Girondi, Havertown, PA (US); Linda A. Carr, Mount Laurel, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/987,255

(22) Filed: Nov. 12, 2004

(65) Prior Publication Data

US 2005/0167319 A1 Aug. 4, 2005

Related U.S. Application Data

(60) Provisional application No. 60/519,138, filed on Nov. 12, 2003.

(51) Int. Cl.
*B65D 25/54* (2006.01)
*B65D 5/475* (2006.01)

(52) U.S. Cl. ..... 206/778; 206/769; 206/776; 229/110; 229/117.24; 229/162.7

(58) Field of Classification Search ..... 229/110, 229/117.24, 117.19, 162.7, 162.1; 206/457, 206/769, 774, 776, 777, 778
See application file for complete search history.

(56) References Cited

U.S. PATENT DOCUMENTS 1,725,211 A * 8/1929 Roser ..... 229/117.19
1,903,540 A 4/1933 Webster
1,983,010 A * 12/1934 Spees ..... 229/117.15
2,162,089 A * 6/1939 Kagen ..... 229/122
2,799,391 A 7/1957 Eisner
3,022,930 A * 2/1962 Kuchenbecker ..... 229/217
3,033,357 A * 5/1962 Brown ..... 206/574
3,241,738 A 3/1966 Freiman
3,294,233 A 12/1966 Hollinger
3,403,839 A * 10/1968 Farquhar ..... 229/112
3,456,865 A * 7/1969 Frank ..... 383/13
3,811,565 A 5/1974 Tancredi
3,870,221 A * 3/1975 Zeitter ..... 229/162.7
4,131,227 A * 12/1978 Patton et al. ..... 229/116.4
4,152,865 A 5/1979 Ikeda
4,203,516 A 5/1980 Stonoga et al.
4,365,438 A 12/1982 Nelson
4,463,852 A * 8/1984 Stone ..... 206/427
4,905,828 A 3/1990 Dods
5,038,930 A 8/1991 Holtkamp, Jr.
5,230,463 A * 7/1993 Brauner ..... 229/138
5,232,087 A 8/1993 Schluger
5,293,994 A 3/1994 Antik
5,358,176 A 10/1994 Rigby (Continued)

*Primary Examiner*—David T. Fidei
(74) *Attorney, Agent, or Firm*—Akin Gump Strauss Hauer & Feld, LLP

(57) ABSTRACT

A toy carrying package having an appearance of a toolbox, and having a handle for convenient transport and a window for viewing an interior of a compartment of the toy carrying package. The compartment is formed from a single sheet of foldable stock material having a plurality of mutually joined panels including first and second major panels each major panel having two opposing major edges and two opposing minor edges, first and second side panels joining together the major panels at the minor edges of the major panels, first and second angled panels extending from the major edges of the major panels, first and second cover panels extending from the angled panels opposite the major panels, and first and second bottom panels extending from the remaining major edges of the major panels.

6 Claims, 5 Drawing Sheets

U.S. PATENT DOCUMENTS 5,370,223 A 12/1994 Leicht, Jr.
5,447,269 A * 9/1995 Fultz ..... 229/120.21
5,487,826 A 1/1996 Back et al.
5,497,876 A 3/1996 Fleming
5,535,940 A * 7/1996 Olds ..... 229/110
5,626,286 A 5/1997 Petkovsek
5,927,495 A 7/1999 Didiano, Jr.
5,961,149 A 10/1999 Hunt
6,070,719 A 6/2000 Pollock
6,206,750 B1 3/2001 Barad et al.
D462,903 S * 9/2002 Yuen ..... D9/432
2002/0162882 A1 * 11/2002 Campbell ..... 229/114

* cited by examiner

TOY CARRYING PACKAGE

CROSS-REFERENCE TO RELATED APPLICATIONS

This application claims benefit of U.S. Provisional Patent Application 60/519,138 "Toy Carrying Package," filed Nov. 12, 2003, which is entirely incorporated by reference herein.

BACKGROUND OF THE INVENTION

The present invention relates generally to carrying packages, and more particularly to carrying packages configured for storing, transporting and/or displaying one or more toys and/or other parts associated therewith.

Storage and carrying packages are generally known in the art, and take a variety of shapes and sizes depending on the desired package size, which is generally dependent on the size of the toy(s) to be stored therein. Some packages are made from a single sheet of stock material, such as cardboard. The package is formed by folding the stock material at designated points, thereby producing a simpler, stronger package since there are a minimal number of joints which need to be artificially joined. Furthermore, storage and transportation packages often include a closure portion, such that the package may be repeatedly opened and closed for accessing the contents which are stored in the package.

However, it is believed that new forms of packages and packaging are desired by consumers for their novelty value, particularly packaging which can be used for storing, displaying and carrying toys and their accessories or game components.

SUMMARY OF THE INVENTION

A toy carrying package formed from a single sheet of foldable stock material comprising: a compartment having a plurality of sides and formed by a plurality of mutually joined panels including: first and second major rectangular panels spaced apart from each other, first and second side panels extending between opposing edges of each of the first and second rectangular panels, each side panel having a frusto-tapered upper end, first and second angled panels, the first angle panel extending from the first rectangular panel between the first and second side panels and the second angled panel extending from the second rectangular panel between the first and second side panels, the compartment having opposing top and bottom open ends; and a number of panels and tabs at each of the top and bottom open ends sufficient to cover and close each open end, each separate panel and tab extending from a separate one of the first and second rectangular panels, first and second angled panels and first and second side panels.

A single sheet of foldable stock material configured to form a toy carrying package and comprising: first and second major panels in spaced apart side by side relation, each of the first and second major panels being rectangular with a pair of opposing major edges and a pair of opposing minor edges extending between the major edges, a first side panel extending between proximal minor edges of each of the first and second major panels, the first side panel joining together the first and second major panels and the first side panel having a frusto-tapered upper end separated from the proximal minor edges of each of the first and second major panels, a second side panel extending from a remaining minor edge of one of the first and second major panels, the second side panel having a frusto-tapered upper end separated from the proximal minor edge of the one of the first and second major panels, first and second angled panels, the first angled panel being rectangular and having a pair of opposing major edges and a pair of opposing minor edges extending between the pair of opposing major edges, the first angled panel extending from a common major edge shared with the first major panel, the second angled panel being rectangular and having a pair of opposing major edges and a pair of opposing minor edges extending between the pair of opposing major edges, the second angled panel extending from a common major edge shared with the second major panel, a first cover panel extending from a remaining major edge of the first angled panel on a side of the first angled panel opposite the first major panel, a second cover panel extending from a remaining major edge of the second angled panel on a side of the second angled panel opposite the second major panel, a first bottom panel extending from a remaining major edge of the first major panel, a second bottom panel extending from a remaining major edge of the second major panel, a slot along the remaining major edge of the first angled panel, an aperture through an interior portion of the second cover panel and a tab extending from a major free edge of the second cover panel opposite the second angled panel, the tab being spaced along the major free edge of the second cover panel a distance from the minor edge of the first major panel proximal the first side panel equal to a distance the slot is spaced from the minor edge of the second major panel proximal the first side panel such that the slot and tab are equally spaced from a center of the first side panel between the proximal minor edges, an aperture through at least part of at least one of the first cover panel and the second cover panel, and a first side panel extending between proximal minor edges of each of the first and second major panels, the first side panel joining together the first and second major panels and the first side panel having a frusto-tapered upper end separated from the proximal minor edges of each of the first and second major panels.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
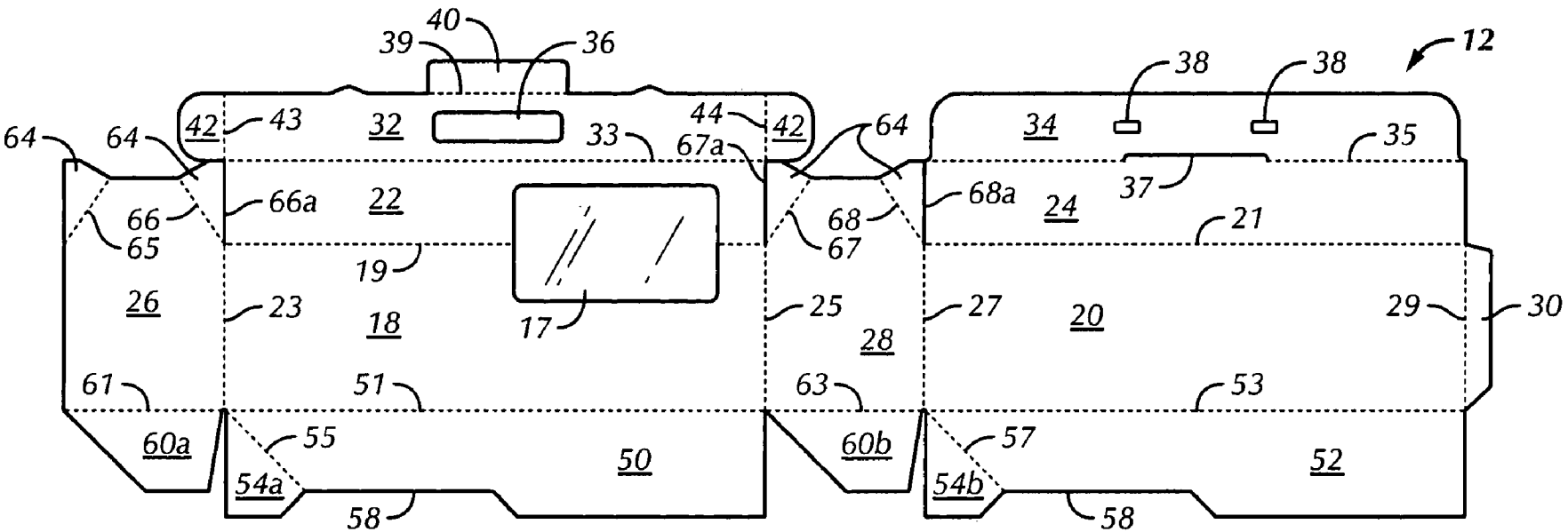
FIG. 1 is a plan view of a blank of stock material used to form a toolbox carrying package according to a first embodiment of the present invention.
Figure 2:
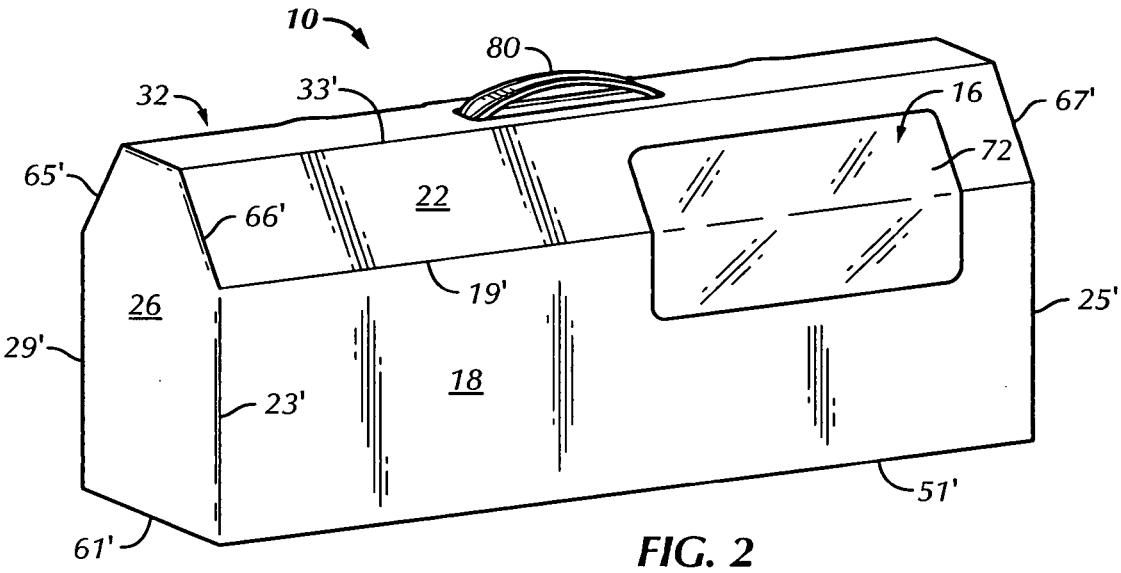
FIG. 2 is a side perspective view of an assembled toolbox package formed from the blank shown in FIG. 1.
Figure 3:
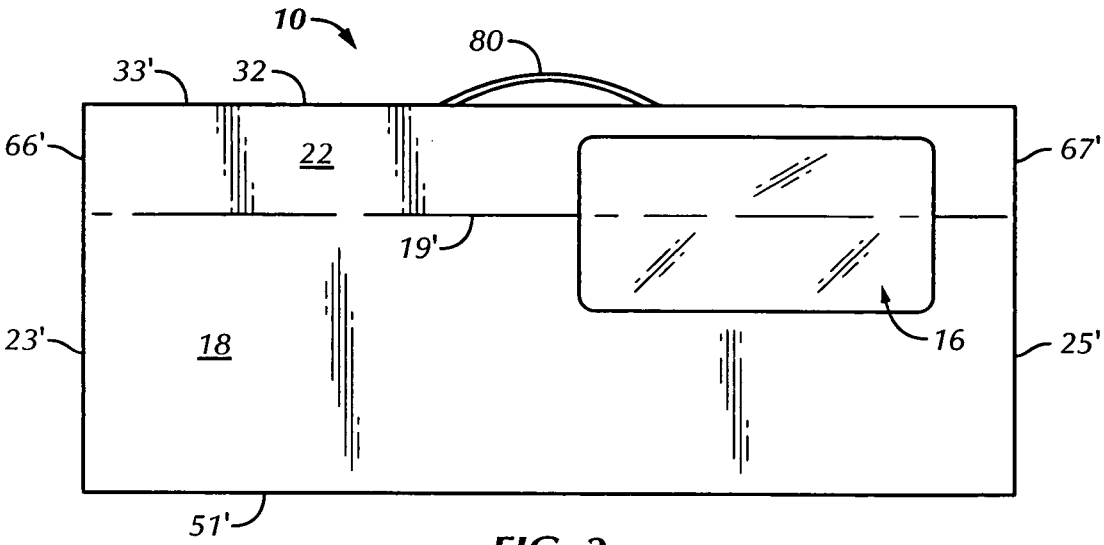
FIG. 3 is a front elevational view of the toolbox package of FIG. 2.
Figure 4:
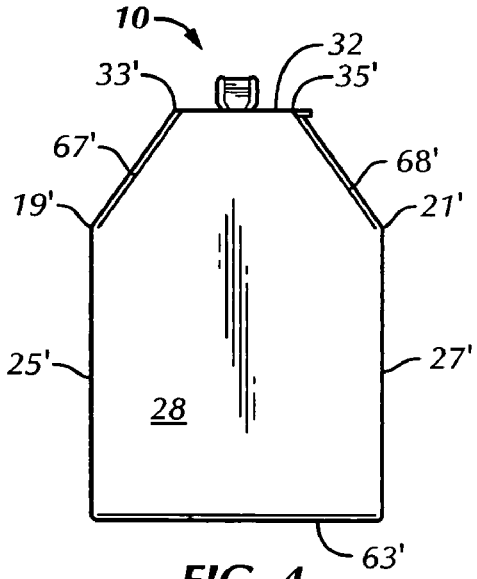
FIG. 4 is a first side view of the mailer package of FIG. 2.

Certain terminology is used in the following description for convenience only and is not considered limiting. The words "right", "left", "lower" and "upper" designate directions in the drawings to which reference is made. The words "inwardly" and "outwardly" refer to directions toward and away from, respectively, the geometric center of the toolbox package and designated parts thereof. The terminology includes the words above specifically mentioned, derivatives thereof and words of similar import.

Referring to the drawings in detail, wherein like numerals indicate like elements throughout, there is shown in FIGS. 1–8 a preferred embodiment of a toy carrying package, generally designated 10, preferably suggesting the appearance of some form of toolbox, for storing, displaying and/or transporting a toy car racing set and/or accessories therefor in accordance with the present invention. The toolbox package 10 is preferably formed from a single sheet of foldable stock material, such as cardboard, of uniform thickness and composition and which is foldable along designated places in the stock material to form the toolbox package 10. Those skilled in the art will recognize that the toolbox package 10 could be formed from other stock material, such as a sufficiently rigid sheet polymer plastic, without departing from the spirit and scope of the present invention. If formed of polymer plastic, some of the prescribed fold lines would be provided as living hinges.

Referring now to FIG. 1, a cardboard blank 12 of the stock material which forms the toolbox package 10 is shown. The blank 12 defines a plurality of joined panels which form the package 10 and a compartment 16 in the package (see FIGS. 2–3). The plurality of joined panels include first and second generally rectangular, major panels 18, 20, respectively. The first and second major panels 18, 20 are preferably approximately the same shape and size. The first major panel 18 preferably includes approximately half of a generally rectangular shaped aperture 17, formed from a cutout of the stock material from the blank 12.

The blank 12 further includes first and second angled panels 22, 24, respectively. The first and second angled panels 22, 24 extend from opposing proximal edges of the first and second panels 18, 20. More particularly, the first angled panel 22 extends from an upper/horizontal major edge of the first major major panel 18 while the second angled panel 22 extends from an upper/horizontal major edge of the second major panel 18, 20. The first and second angled panels 22, 24 preferably have the same dimensions as each other, but are preferably smaller than the first and second panels 18, 20. The first and second angled panels 22, 24 have a length which is approximately equal to the length of the first and second major panels 18, 20. The first angled panel 22 extends from the first major panel 18 along a first fold line 19 in the stock material. The first fold line 19 defines a first edge (upper/major/horizontal) of the first major panel 18 and (lower/major/horizontal) of the first angled panel 22. The first angled panel 22 includes the remaining portion of the rectangular recess 17, such that the rectangular recess 17 spans a portion of each of the first major panel 18 and the first angled panel 22. The second angled panel 24 similarly extends from the second major panel 20 along a second fold line 21 which defines a first edge (upper/major/horizontal) of the second major panel 20 and (lower/major/horizontal) of the second angled panel 24.

The blank 12 further includes first and second side panels 26, 28, respectively, which are parallel with each other and which extend along opposing side (minor/vertical) edges of the first and second panels 18, 20. The first and second side panels 26, 28 preferably have the same dimensions as each other, but are preferably smaller than the first and second major panels 18, 20. The first and second side panels 26, 28 have a length (height), which is approximately equal to the combined width (height) of one of the panels 18, 20 and one of the angled panels 22, 24. The first side panel 26 extends from the first major panel 18 along a third fold line 23, which extends the width (height) of the first major panel 18. The third fold line 23 defines a second edge (a first minor/vertical edge) of the first major major panel 18 and the first side panel 26. The second side panel 28 extends from the first major panel 18 along a fourth fold line 25 which extends the width (height) of the first major panel 18. The fourth fold line 25 defines a third edge (a second minor/vertical edge) of the first major major panel 18 and a first (vertical) edge of the second side panel 28. The second side panel 28 further extends from the second major major panel 20 along a fifth fold line 27, which extends the width (height) of the second panel 20. The fifth fold line 24 defines a second edge (first minor/vertical edge) of the second major panel 20 and a second (vertical) edge of the second side panel 28.

Generally trapezoidal shaped side end tabs 60*a*, 60*b* extend from the first and second side panels 26, 28 along first and second end tab fold lines 61, 63, respectively. The side end tabs 60*a*, 60*b* extend from ends of the first and second side panels 26, 28 which are opposite the first and second angled panels 22, 24. The side panels 26, 28 preferably each include a pair of generally triangular corner sections 64 at the end of the side panels 26, 28 which are opposite the side end tabs 60*a*, 60*b*. The side corner sections 64 extend from the first side panel 26 along side corner fold lines 65, 66, and from the second side panel 28 along side corner fold lines 67, 68. Fold lines 65, 66 and 67, 68 also form frusto-triangular peaks of the first and second side panels 26 and 28, respectively. The side corner sections 64, which are adjacent the first and second angled panels 22, 24, are not attached to the angled panels 22, 24, but rather are separated by slits 66*a*, 67*a*, 68*a* in the blank 12 and merely extend along the width of the first and second angled panels 22, 24 parallel thereto. Corner sections can be kept to provide support and bias to keep the first and second angled panels 22, 24 aligned with the peaks of the side panels 26, 28. It will be appreciated that the side corner sections 64 can be deleted or removed, if desired.

A closure tab 30 extends from the second major panel 20 along a sixth fold line 29 which defines a third edge (second, minor/vertical edge) of the second major panel 20. The closure tab 30 is preferably coated on one of the major surfaces thereof with an adhesive material having sufficient tack to permanently securely attach the closure tab 30 to another portion of the stock material.

Upper and lower cover panels 32, 34 extend from the first and second angled panels 22, 24, along upper and lower cover fold lines 33, 35, respectively. Fold lines 33, 35 form cover edges (second, major/horizontal/upper edges) of the first and second angled panels 22, 24. The lower cover fold line 35 includes an opening preferably in the form of a slit 37, approximately in the center of thereof adjoining fold line 35. The cover panels 32, 34 have a length which is approximately equal to the lengths of the first and second angled panels 22, 24. The upper cover panel 32 preferably includes a generally rectangular shaped aperture 36 approximately in the center of the upper cover panel 32. The lower cover panel 34 preferably includes a pair of smaller rectangular shaped apertures 38, spaced from each other and generally centered within the lower cover panel 34.

Cover panel end tabs 42 extend from opposing (minor) ends of the upper cover panel 32 along cover panel fold lines 43, 44, respectively, forming minor opposing edges of cover panel 32. A cover closure tab 40 extends from the upper cover panel 32 along an upper cover closure fold line 39 along a fourth (second major) edge of the cover panel 32. The cover closure tab 40 is generally centered along the length of the upper closure panel 32 and is centered with respect to the aperture 36 in the upper cover panel 32 so as to be inserted into the aperture 36.

First and second bottom panels 50, 52 extend from the first and second major panels 18, 20, respectively. The first bottom panel 50 extends from the first major panel 18 along a first bottom panel fold line 51, which forms a fourth edge (second major horizontal/lower edge) of the first major panel 18 and a first major edge of the first bottom panel 50. The second bottom panel 52 extends from the second major panel 20 along a second bottom panel fold line 53, which forms a fourth edge (second major horizontal/lower edge) of the second major panel 20 and a first major edge of the second bottom panel 52. The bottom panels 50, 52 include corner sections 54*a*, 54*b*, which are attached to the first and second bottom panels 50, 52 along corner fold lines 55, 57, respectively. Each of the first and second bottom panels 50, 52 preferably further includes a notched or recessed portion 58 along the free, distal edge of the bottom panel 50, 52, which is opposite the respective bottom panel fold line 51, 53, respectively, and the first and second major panels 18, 20.

FIGS. 2–8 show the toolbox package 10 which is formed by folding and bending the above-described portions of the blank 12. The toolbox package 10 is formed by folding the blank 12 along the third fold line 23 such that the first major panel 18 forms approximately a right angle with the first side panel 26, forming a common second edge 23' of the first major panel 18 and the first side panel 26. The blank 12 is also folded along the fourth fold line 25 such that the first major panel 18 forms a right angle with the second side panel 28, thereby producing a common third edge 25'. The blank 12 is then folded along the fifth fold line 27 such that the second major panel 20 forms approximately a right angle with the second side panel 28 and such that the first major panel 18 is parallel to and is spaced apart from the second panel 20. The fold along the fifth fold line 27 produces a common second edge 27' of the second major panel 20 and the second side panel 28. In this position, the first and second side panels 26, 28 are parallel to and spaced from each other.

The blank 12 is folded along the sixth fold line 29 such that the closure tab 30 forms approximately a right angle with the second panel 20. When the second major panel 20 is folded along the fifth fold line 27, the closure tab 30 aligns with and contacts the interior surface of the first side panel 26 which is opposite the second side 28, and adheres to the first side panel 26 using the adhesive material thereon. A common third edge 29' of the second major panel 20 is thus formed by the intersection of the second panel 20, the first side panel 26 and the closure tab 30. Those skilled in the art will recognize that adhesive material may be on the first side panel 26 in addition to or in place of adhesive material on the closure tab 30 and that the closure tab 30 can be secured on either side of side panel 26.

A generally rectangular shaped interior compartment 16 is thus formed by the first and second panels 18, 20 and the first and second side panels 26, 28 by folding the blank 12 along the identified fold lines as described. The compartment 16 is sized to accommodate one or more toys, game pieces and/or accessories (not shown) for storage, transport and/or display within the toolbox package 10 (see FIGS. 2 and 3). A preferably transparent window 72 is formed by a clear, flexible plastic sheet, preferably attached to the interior surface of the first major panel 18 and first angled panel 22 by suitable means such as an adhesive. The plastic sheet covers and extends outwardly around aperture 17. The resulting window 72 allows at least some of the contents of the interior compartment 16 to be viewed through the otherwise opaque panels forming the walls of the package 10.

Figure 5:
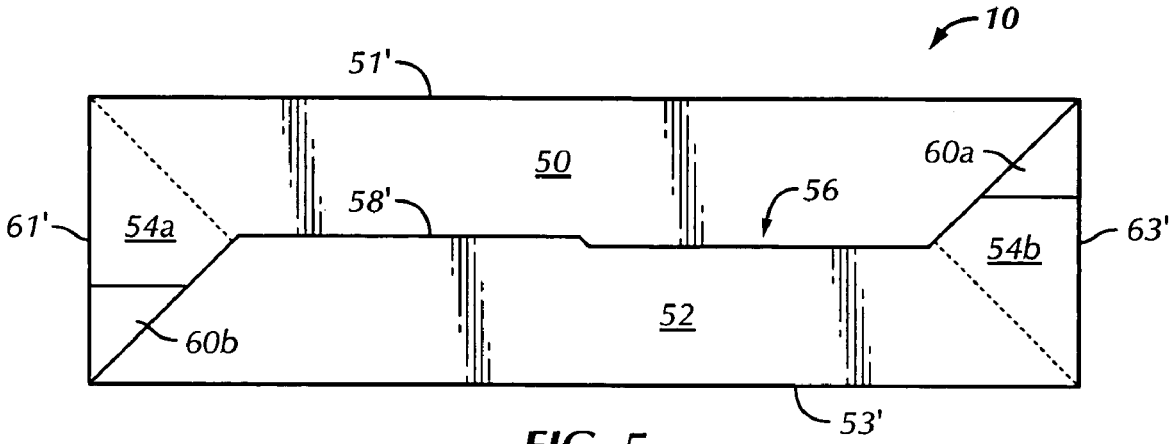
FIG. 5 is a bottom view of the toolbox package of FIG. 2.
Figure 6:
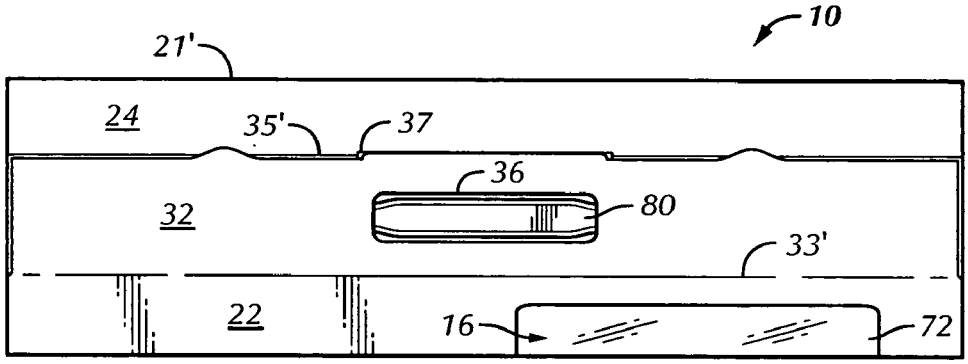
FIG. 6 is a top view of the toolbox package of FIG. 2.
Figure 7:
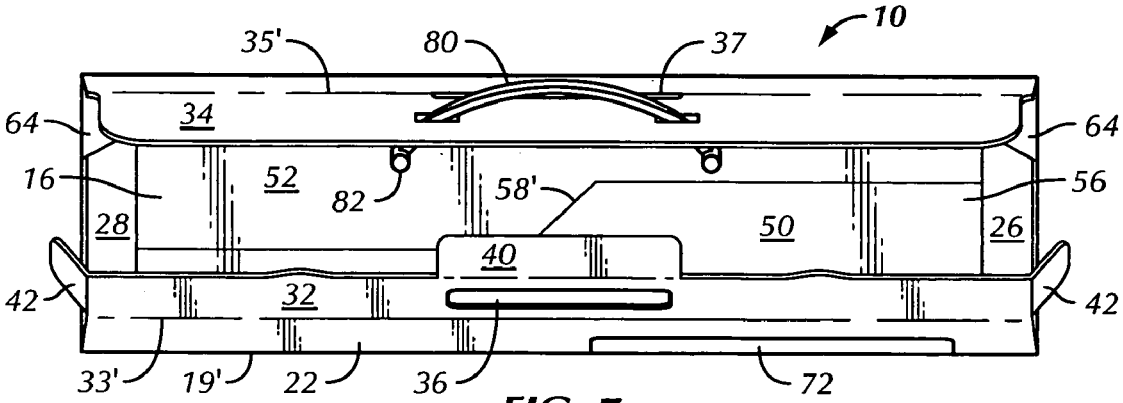
FIG. 7 is a top view of a toolbox package formed from the blank shown in FIG. 1 with top panels open.
Figure 8:
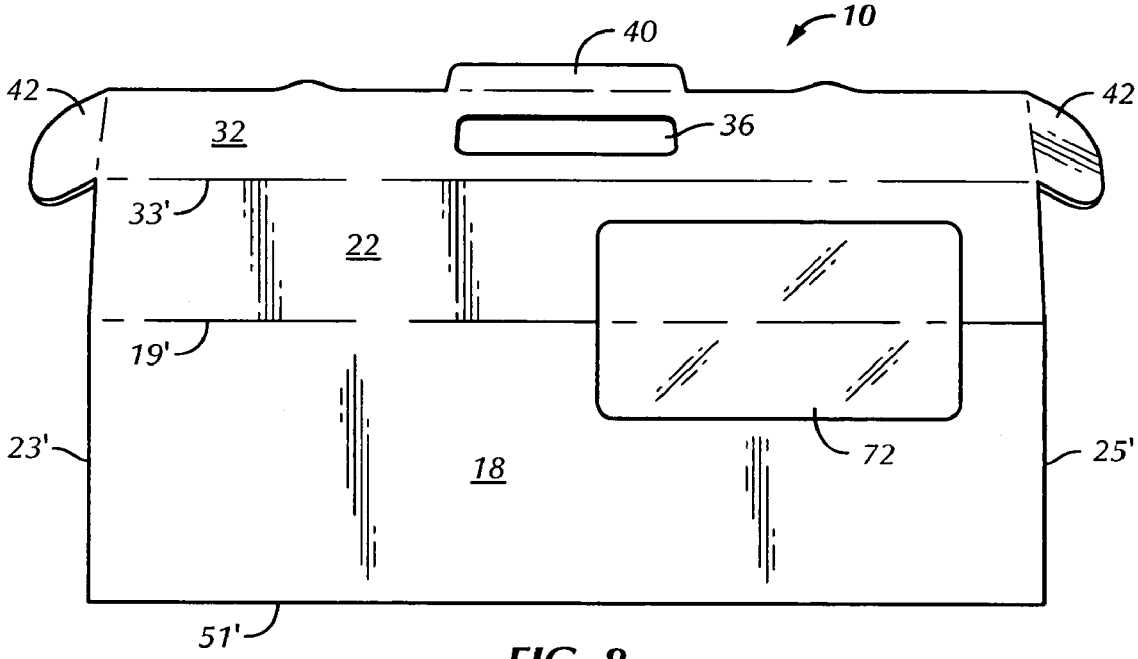
FIG. 8 is a front elevational view of the toolbox package of FIG. 7.

When the first and second major panels 18, 20 are brought into a parallel relationship to each other, the first and second bottom panels 50, 52 and the side end tabs 60*a*, 60*b* are brought together to form a bottom 56 of the toolbox package 10. The bottom 56 is assembled by folding the blank 12 along the first bottom panel fold line 51 such that the first major panel 18 forms approximately a right angle with the first bottom panel 50. The resulting fold produces a common fourth edge 51' of the first major panel 18 and the first bottom panel 50. Similarly, the blank 12 is folded along the second bottom panel fold line 53 such that the second major panel 20 forms approximately a right angle with the second bottom panel 52, forming a common fourth edge 53' of the second major panel 20 and the second bottom panel 52. As the first and second bottom panels 50, 52 are folded inwardly toward each other, the side end tabs 60*a*, 60*b* are also folded inwardly along the end tab fold lines 61 and 63, such that the side end tabs 60*a*, 60*b* form approximate right angles with the first and second side panels 26, 28. The first side end tab 60*a* is folded over and parallel to the second bottom panel 52, and the corner section 54*a* preferably is adhered to the first side end tab 60*a* with an adhesive which is placed on one or both of the corner section 54*a* and the first side end tab 60*a*. Accordingly, a common first bottom edge 61' is formed by the intersection of the first side end tab 60*a*, the first corner section 54*a* and the second bottom panel 52. Similarly, the second side end tab 60*b* is folded over and parallel to the first bottom panel 51, and the second corner section 54*b* preferably is adhered to the second side end tab 60*b*, with an adhesive that is placed on one or both of the corner section 54*b* and the second side end tab 60*b*. Thus a common second bottom edge 63' is formed at the intersection of the second side end tab 60*b*, the second corner section 54*b* and the first bottom panel 51. Simultaneously, the notched portions 58 on the major free edges of the first and second bottom panels 50, 52 overlap and interlock with each other in a manner well understood by those skilled in the art, thereby securing the bottom panels 50, 52 to each other, resulting in an interlocked seam 58', and completing the bottom 56. The overlapped portions of the bottom panels 50, 52 could also be adhered together to strengthen the weight bearing capacity of the bottom, if desired. FIGS. 5 and 7 show partially assembled views of the toolbox 10 with the completed bottom 56.

The side corner sections 64, if provided, are folded inward toward the compartment 16 along the side corner fold lines 65, 66, 67, 68, such that the side corner sections 64 form approximate right angles with respect to their respective side end panels 26, 28. The first angled panel 22 is folded inwardly along the first fold line 19 and rests against the proximal side corner section 64, forming common angled edges 66', 67' (FIG. 2) at the intersection of the first angled panel 22, the respective side panel 26, 28, and the respective side corner section 64. Preferably, the plastic sheet 72' is sufficiently flexible to bend along the first fold line 19 with the first angled panel 22. Similarly, the second angled panel 24 is folded inwardly along the second fold line 21, and rests against the proximal side corner sections 64 on the side panels 26, 28, thereby forming common angled edges 65', 68'. The first and second angled panels 22, 24 preferably each form approximately a forty-five degree angle with respect to their respective first and second major panels 18, 20, thereby forming common first edges 19' and 21', respectively.

The lower cover panel 34 is folded along the lower cover fold line 35, such that the lower cover panel 34 extends over the upper, horizontal free edge of each side panel 26, 28 and covers the compartment 16 and is substantially parallel to the bottom 56. A handle 80 of a style generally known in the art (molded plastic with "T" shaped distal ends), is attached to the lower cover panel 34 by inserting the hook ends of the handle 82 (cross member of each "T") into the rectangular recesses 38 in the lower cover panel 34. Thus, the handle 80 projects upwardly in a curved manner from the lower cover panel 34. While the handle 80 is preferably made of plastic, it may be made of other materials well known in the art, such as rubber, and other forms of handles with other forms of hook and/or stop members or even adhesive can be used to provide the handle portion of the blank formed package 10.

The upper cover panel 32 is folded in a similar manner over the lower cover panel 34 along the upper cover fold line 33 such that the upper cover panel 32 is parallel with respect to both the bottom 56 and the lower cover panel 34, thereby forming a common cover edge 33' at the intersection of the upper cover panel 32 and the first angled panel 22 and a common cover edge 35' at the intersection of the upper and lower cover panels 32, 34 and the second angled panel 24. The aperture 36 in the upper cover panel 32 preferably aligns with the handle 80 projecting from the lower cover panel 34, such that the handle 80 can be passed through the aperture 36 so as to project upwardly from both the upper and lower cover panels 32, 34. The handle 80 may be grasped by a user to lift and carry the toolbox package 10. The handle 80 projecting through the aperture 36 also helps the upper cover panel 32 to align with the lower cover panel 34 and effectively releasably secures the cover panels 32, 34 together.

The upper cover panel 32 is releasably secured over the lower cover panel 32, and thus the compartment 16, by folding the cover panel end tabs 42 inwardly along the cover panel fold lines 43, 44 and inserting the folded cover panel end tabs 42 downward into the compartment 16 along the side panels 26, 28. Additionally, the cover closure tab 40 is folded along the upper cover closure line 39, such that the cover closure tab 40 is approximately at a right angle with respect to the upper cover panel 32. The cover closure tab 40 is then inserted in the slit 37 in the lower cover fold line 35 (i.e., the cover edge 35'). Thus, the compartment 16 may be repeatedly opened and closed by releasing the cover closure tab 40 and the cover panel end tabs 42 to release the upper and lower cover panels 32, 34.

The toolbox package 10 thus provides a re-useable, re-closable storage, transportation and display case for toys, game pieces and their accessories. The toolbox package 10 may be carried by the handle 80 and opened and re-closed as described above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

We claim:

1. A single sheet of foldable stock material configured to form a toy carrying package and comprising:

first and second major panels in spaced apart side by side relation, each of the first and second major panels being rectangular with a pair of opposing major edges and a pair of opposing minor edges extending between the major edges, a first side panel extending from a minor edge of one of the first and second major panels, the first side panel having a frusto-tapered upper end separated from a proximal minor edge of the one of the first and second major panels, a second side panel extending between proximal minor edges of each of the first and second major panels, the second side panel joining together the first and second major panels and the second side panel having a frusto-tapered upper end separated from the proximal minor edges of each of the first and second major panels, first and second angled panels the first angled panel being rectangular and having a pair of opposing major edges and a pair of opposing minor edges extending between the pair of opposing major edges, the first angled panel extending from a common major edge shared with the first major panel, the second angled panel being rectangular and having a pair of opposing major edges and a pair of opposing minor edges extending between the pair of opposing major edges, the second angled panel extending from a common major edge shared with the second major panel, a first cover panel extending from a remaining major edge of the first angled panel on a side of the first angled panel opposite the first major panel, a second cover panel extending from a remaining major edge of the second angled panel on a side of the second angled panel opposite the second major panel, a first bottom panel extending from a remaining major edge of the first major panel, a second bottom panel extending from a remaining major edge of the second major panel, a slot along the remaining major edge of the second angled panel, an aperture through an interior portion of the first cover panel and a tab extending from a major free edge of the first cover panel opposite the first angled panel, the tab being spaced along the major free edge of the first cover panel a distance from the minor edge of the first major panel proximal the second side panel equal to a distance the slot is spaced from the minor edge of the second major panel proximal the second side panel such that the slot and tab are equally spaced from a center of the second side panel between the proximal minor edges, and an aperture through at least part of at least one of the first major panel and the first angled panel.

2. The toy carrying package of claim 1 further comprising a plurality of side corner sections on the first and second side panels, the side corner sections bordering the angled panels when the angled panels are folded against the tapered upper end of each of the first and second side panels.

3. The toy carrying package of claim 1 further comprising a handle extending from at least one of the plurality of panels to carry the package.

4. The toy carrying package of claim 3 wherein the handle extends from a lower cover panel through an aperture of an upper cover panel.

5. The toy carrying package of claim 1 further comprising a window covering the aperture.

6. The toy carrying package of claim 5 wherein the window is a transparent, flexible plastic sheet.

* * * * *